US011304267B2

(12) United States Patent
Ok et al.

(10) Patent No.: US 11,304,267 B2
(45) Date of Patent: Apr. 12, 2022

(54) INDUCTION HEATING DEVICE HAVING IMPROVED SWITCH STRESS REDUCTION STRUCTURE

(71) Applicant: LG ELECTRONICS INC., Seoul (KR)

(72) Inventors: Seungbok Ok, Seoul (KR); Dooyong Oh, Seoul (KR); Jae-Woo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 444 days.

(21) Appl. No.: 16/353,655

(22) Filed: Mar. 14, 2019

(65) Prior Publication Data

US 2020/0120762 A1 Apr. 16, 2020

(30) Foreign Application Priority Data

Oct. 10, 2018 (KR) ..... 10-2018-0120562

(51) Int. Cl.
*H05B 6/06* (2006.01)
*H05B 6/12* (2006.01)

(52) U.S. Cl.
CPC ..... *H05B 6/065* (2013.01); *H05B 6/1209* (2013.01)

(58) Field of Classification Search
CPC ..... H05B 6/062; H05B 6/1236; H05B 6/065; H05B 2213/05; H05B 6/1209
USPC ..... 219/664, 665, 518, 620, 626, 660, 675, 219/676, 447.1, 448.13; 363/56.01
See application file for complete search history.

(56) References Cited

U.S. PATENT DOCUMENTS 10,959,296 B2 * 3/2021 Yun ..... H05B 6/065
2015/0250027 A1 9/2015 Takano et al.
2018/0242406 A1 8/2018 Yun

FOREIGN PATENT DOCUMENTS

| | | |
|---|---|---|
| CN | 204014137 | 12/2014 |
| EP | 2928265 | 10/2015 |
| EP | 3364717 | 8/2018 |
| FR | 2275105 | 1/1976 |
| JP | 4074206 | 4/2008 |

OTHER PUBLICATIONS

EP Search Report in European Application No. EP19167355, dated Oct. 30, 2019, 9 pages.

* cited by examiner

*Primary Examiner* — Quang T Van
(74) *Attorney, Agent, or Firm* — Fish & Richardson P.C.

(57) ABSTRACT

An induction heating device includes first and second working coils connected electrically in parallel, an inverter unit configured to switch at least one of the first working coil or the second working coil, an inverter driving unit connected to the inverter unit; a first semiconductor switch connected to the first working coil, a first semiconductor switch driving unit connected to the first semiconductor switch, an overcurrent protection unit connected to the first semiconductor switch, configured to generate information based on a current that flows in the first semiconductor switch, and configured to, based on the information, determine whether to turn off the inverter driving unit, and a control unit that is configured to receive the information, and determine, based on the information, whether to block a pulse signal to the inverter driving unit and whether to turn off the first semiconductor switch driving unit.

15 Claims, 6 Drawing Sheets

INDUCTION HEATING DEVICE HAVING IMPROVED SWITCH STRESS REDUCTION STRUCTURE

CROSS-REFERENCE TO RELATED APPLICATION

This application claims priority to and the benefit of Korean Patent Application No. 10-2018-0120562, filed on Oct. 10, 2018, the disclosure of which is incorporated herein by reference in its entirety.

TECHNICAL FIELD

This application relates to an induction heating device improved with a switch stress reduction structure.

BACKGROUND

In homes and restaurants, various cooking devices are used to heat food. For example, a gas range uses gas as fuel to heat food. In some cases, cooking devices may use electricity to heat a cooking vessel such as an object to be heated, for example, a pot.

In some cases, a method of heating an object to be heated using electricity may be classified into a resistive heating method and an induction heating method. In the electric resistance method, heat may be generated when a current flows to a non-metallic heating element such as silicon carbide or a metal resistance wire, and the heat may be transmitted to the object to be heated through a radiation or conduction, thereby to heat the object to be heated. In the induction heating method, an eddy current may be generated in the object to be heated (for example, a cooking vessel) made of a metal based on a magnetic field generated around the coil when a high-frequency power of a predetermined magnitude is applied to the coil this method, the object itself may be heated by the eddy current in the object.

In some examples, an induction heating device may include a working coil in a corresponding area respectively, to heat each of a plurality of target objects (for example cooking vessels).

In some cases, an induction heating device (i.e., a ZONE FREE type induction heating device) may simultaneously heat a target object with a plurality of working coils.

In some cases, a ZONE FREE type induction heating device may inductively heat the target object regardless of a size and a position of a target object in an area where the plurality of working coils exist.

FIG. 1 is a schematic view explaining a ZONE FREE type induction heating device in related art.

The reference numerals used in FIG. 1 are applied only to FIG. 1.

As shown in FIG. 1, a ZONE FREE type induction heating device 10 includes a structure in which the semiconductor switches T1 to Tn for coil switching are connected for each of a plurality of induction coils L1 to Ln in order to control an individual output of the plurality of induction coils L1 to Ln. That is, in order to control the output of each of the induction coils L1 to Ln, there is a need to separately turn on/turn off the semiconductor switches T1 to Tn.

In some cases, when the corresponding semiconductor switch T1 is turned-off when an over-current, flows in a semiconductor switch (for example, T1), as switch stress is instantaneously applied to the corresponding semiconductor switch T1 according to a counter electromotive force formula (L*di/dt; L is an inductance and di s a resonance current change amount, and dt is a time change amount) related to an induction coil, a voltage spike or a damage may be generated according to an increase in a heating value.

In the ZONE FREE type induction heating device 10, the Free Wheeling Diodes D1 to Dn (Free Wheeling Diode) may be additionally mounted for each semiconductor switches T1 to Tn in order to reduce the switch stress.

In some cases, due to additional mounting of the Free Wheeling Diodes in the ZONE FREE type induction heating device 10, heat may increase according to heat generation of the Free Wheeling Diodes D1 to Dn, and heat may increase in a circuit area. In some cases, a manufacturing cost may increase due to the addition of the Free Wheeling Diodes D1 to Dn.

SUMMARY

This application describes an induction heating device capable of an independent output control for a plurality of working coils.

This application also describes an induction heating device capable of reducing switch stress without a Free Wheeling Diode.

This application also describes an induction heating device capable of solving a noise problem that occurs in a relay switching operation and reducing a circuit volume by removing a relay and a Wheeling Diode.

The objects of this application include, but are not limited to the above-mentioned aspects, and the other objects and the advantages of this application, which are not mentioned, can be understood by the following description, and more clearly understood by the implementations of this application. It will be also readily seen that the objects and the advantages of this application may be realized by means indicated in the claims and a combination thereof.

According to one aspect of the subject matter described in this application, an induction heating device includes a working coil unit including a first working coil and a second working coil that are connected electrically in parallel, an inverter unit configured to perform a switching operation by applying a resonance current to at least one of the first working coil or the second working coil, an inverter driving unit connected to the inverter unit and configured to control the switching operation of the inverter unit, a first semiconductor switch connected to the first working coil and configured to turn on and turn off the first working coil, a first semiconductor switch driving unit connected to the first semiconductor switch and configured to control the first semiconductor switch, an over-current protection unit that is connected to the first semiconductor switch, that is configured to generate first information based on a current that flows in the first semiconductor switch, and that is configured to, based on the first information, determine whether to turn on or off the inverter driving unit, and a control unit. The control unit is configured to receive the first information from the over-current protection unit, and determine, based on the first information, whether to block or unblock a pulse signal to the inverter driving unit and whether to turn on or off the first semiconductor switch driving unit.

Implementations according to this aspect may include one or more of the following features. For example, the over-current protection unit may be configured to, based on the first information indicating that a magnitude of the current that flows in the first semiconductor switch is greater than or equal to a preset over-current magnitude, turn off the inverter driving unit, where the control unit may be further configured to, based on the first information indicating that the magnitude of the current that flows in the first semiconductor switch is greater than or equal to the preset over-current magnitude, block the pulse signal to the inverter driving unit and turn off the first semiconductor switch driving unit.

In some implementations, the control unit may be further configured to, based on the over-current protection unit having turned off the inverter driving unit, block the pulse signal to the inverter driving unit and turn off the first semiconductor switch driving unit. In some implementations, the over-current protection unit may include: a first current transformer configured to convert a magnitude of a current that flows between the first working coil and the first semiconductor switch; a rectifier configured to receive a magnitude-converted current from the first current transformer and rectify the magnitude-converted current; an RC filter configured to receive a rectified current from the rectifier and reduce a noise of the rectified current; and a comparator. The comparator may be configured to: receive a noise-reduced current from the RC filter, compare a magnitude of the noise-reduced current with a preset over-current magnitude; generate the first information based on a comparison result of the magnitude of the noise-reduced current with the preset over-current magnitude; based on the first information, determine whether to turn on or off the inverter driving unit; and provide the first information to the control unit.

In some implementations, the comparator may be configured to, based on the first information indicating that the magnitude of the noise-reduced current from the RC filter is greater than or equal to the preset over-current magnitude, turn off the inverter driving unit. The control unit may be configured to, based on the first information indicating that the magnitude of the noise-reduced current from the RC filter is greater than or equal to the preset over-current magnitude, block the pulse signal to the inverter driving unit and turn off the first semiconductor switch driving unit.

In some examples, the control unit may be further configured to, based on the comparator having turned off the inverter driving unit, block the pulse signal to the inverter driving unit and turn off the first semiconductor switch driving unit. In some examples, the first current transformer includes a primary coil connected between the first working coil and the first semiconductor switch and a secondary coil connected to the rectifier.

In some implementations, the over-current protection unit may include: a first shunt resistor connected between the first semiconductor switch and a ground; a rectifier configured to rectify a voltage applied to the first shunt resistor; an RC filter configured to receive a rectified voltage from the rectifier and configured to reduce a noise of the rectified voltage; and a comparator. The comparator may be configured to: receive a noise-reduced voltage from the RC filter; compare a magnitude of the noise-reduced voltage with a preset over-voltage magnitude; generate the first information based on a comparison result of the magnitude of the noise-reduced voltage with the preset over-voltage magnitude; based on the first information, determine whether to turn on or off the inverter driving unit; and provide the first information to the control unit. In some examples, the comparator may be configured to, based on the first information indicating that the magnitude of the noise-reduced voltage received from the RC filter is greater than or equal to the preset over-voltage magnitude, turn off the inverter driving unit. The control unit may be configured to, based on the first information indicating that the magnitude of the noise-reduced voltage received from the RC filter is greater than or equal to the preset over-voltage magnitude, block the pulse signal to the inverter driving unit and turn off the first semiconductor switch driving unit.

In some examples, the control unit may be further configured to, based on the comparator having turned off the inverter driving unit, block the pulse signal to the inverter driving unit and turn off the first semiconductor switch driving unit. The inverter unit may include a first switching element and a second switching element that are configured to perform the switching operation, where the inverter driving unit may include: a first sub-inverter driving unit connected to the first switching element and configured to turn on and turn off the first switching element; and a second sub-inverter driving unit connected to the second switching element and configured to turn on and turn off the second switching element.

In some implementations, the comparator may be configured to, based on the first information indicating that a magnitude of the current that flows in the first semiconductor switch is greater than or equal to a preset over-current magnitude, turn off the first sub-inverter driving unit and the second sub-inverter driving unit. The control unit may be configured to, based on the first information indicating that the magnitude of the current that flows in the first semiconductor switch is greater than or equal to the preset over-current magnitude, block a first pulse signal to the first sub-inverter driving unit and a second pulse signal to the second sub-inverter driving unit, and turn off the first semiconductor switch driving unit.

In some implementations, the control unit may be further configured to, based on the over-current protection unit having turned off the first sub-inverter driving unit and the second sub-inverter driving unit, block the first pulse signal and the second pulse signal and turn off the first semiconductor switch driving unit.

In some implementations, the induction heating device may further include a second semiconductor switch connected to the second working coil and configured to turn on and turn off the second working coil, and a second semiconductor switch driving unit connected to the second semiconductor switch and configured to control the second semiconductor switch.

In some examples, the over-current protection unit is connected to the second semiconductor switch, and may be configured to generate second information based on a current that flows in the second semiconductor switch and to determine whether to turn on or off the inverter driving unit based on the second information. The control unit may be further configured to: receive the second information from the over-current protection unit, and based on the second information, determine whether to block or unblock the pulse signal to the inverter driving unit and whether to turn on or off the second semiconductor switch driving unit.

In some examples, the over-current protection unit may be configured to, based on a first current flowing in the first semiconductor switch and a second current flowing in the second semiconductor switch, simultaneously or sequentially generate the first information and the second information. The control unit may be configured to, based on a first current flowing in the first semiconductor switch and a second current flowing in the second semiconductor switch, simultaneously or sequentially receive the first information and the second information from the over-current protection unit.

In some implementations, the over-current protection unit may be configured to, based on the first current flowing in the first semiconductor switch and the second current flowing in the second semiconductor switch, simultaneously generate the first information and the second information. The control unit may be configured to, based on the first current flowing in the first semiconductor switch and the second current flowing in the second semiconductor switch, simultaneously receive the first information and the second information from the over-current protection unit.

In some implementations, the over-current protection unit may be configured to, based on the first current flowing in the first semiconductor switch and the second current flowing in the second semiconductor switch, sequentially generate the first information and the second information. The control unit may be configured to, based on the first current flowing in the first semiconductor switch and the second current flowing in the second semiconductor switch, sequentially receive the first information and the second information from the over-current protection unit.

In some examples, the first current transformer is disposed between the first working coil and the first semiconductor switch. In some examples, the over-current protection unit may include: a first current transformer disposed between the first working coil and the first semiconductor switch and configured to convert a magnitude of a first current that flows between the first working coil and the first semiconductor switch; and a second current transformer between the second working coil and the second semiconductor switch and configured to convert a magnitude of a second current that flows between the second working coil and the second semiconductor switch, where one end of each of the first semiconductor switch and the second semiconductor switch is connected to a ground terminal.

The induction heating device includes a control unit that controls an operation of a plurality of semiconductor switches respectively, and an inverter unit, so that the independent output control for the plurality of working coils may be possible.

In some implementations, the induction heating device further includes an over-current protection unit that determines turning off or not turning off of an inverter driving unit by analyzing a current that flows in a semiconductor switch and a control unit that determines turning off or not turning off of a pulse single provided to the inverter driving unit and turning off or not turning off of a semiconductor switch driving unit based on a received analysis result from the over-current protection unit, thereby reducing the switch stress without the Free Wheeling Diode.

In some implementations, the induction heating device may reduce noise which may occur in the relay switching operation by performing an output control operation on the working coil by using the semiconductor switch instead of the relay, and by removing the relay and the Free Wheeling Diode, it may be possible to reduce the circuit volume.

In some implementations, the induction heating device may enable independent output control with regard to the plurality of working coils by independently dividing the plurality of working coils and turning-on or turning-off each working coil at a high speed through the semiconductor switch and the control unit.

In some implementations, the induction heating device may reduce the switch stress without the Free Wheeling Diode by firstly turning-off the inverter driving unit before turning-off the pulse signal and the semiconductor switch driving unit. In some implementations, through the switch stress reduction, a prevention of occurrence of a voltage spike and a heating value reduction of the semiconductor switch may be possible, and a product lifespan and reliability may be improved.

In some implementations, the induction heating device may reduce noise, which may occur in the switching operation of the relay by performing the output control operation on the working coil by using the semiconductor switch instead of the relay, which may improve a user satisfaction. In some examples, since the user can quietly use the induction heating device in a time zone (for example, at dawn or at late night) sensitive to a noise problem, a use convenience can be improved. In some implementations, it may be possible to reduce the circuit volume by removing the relay and Free Wheeling Diode that could occupy a large area in a circuit, which may enable a reduction of a total volume of the induction heating device. In some cases, it may be possible to improve space utilization by reducing the total volume of the induction heating device.

Hereafter, a specific effect of this application, in addition to the above-mentioned effects, will be described together while describing a specific matter for implementing this application.

DETAILED DESCRIPTION

Figure 1:
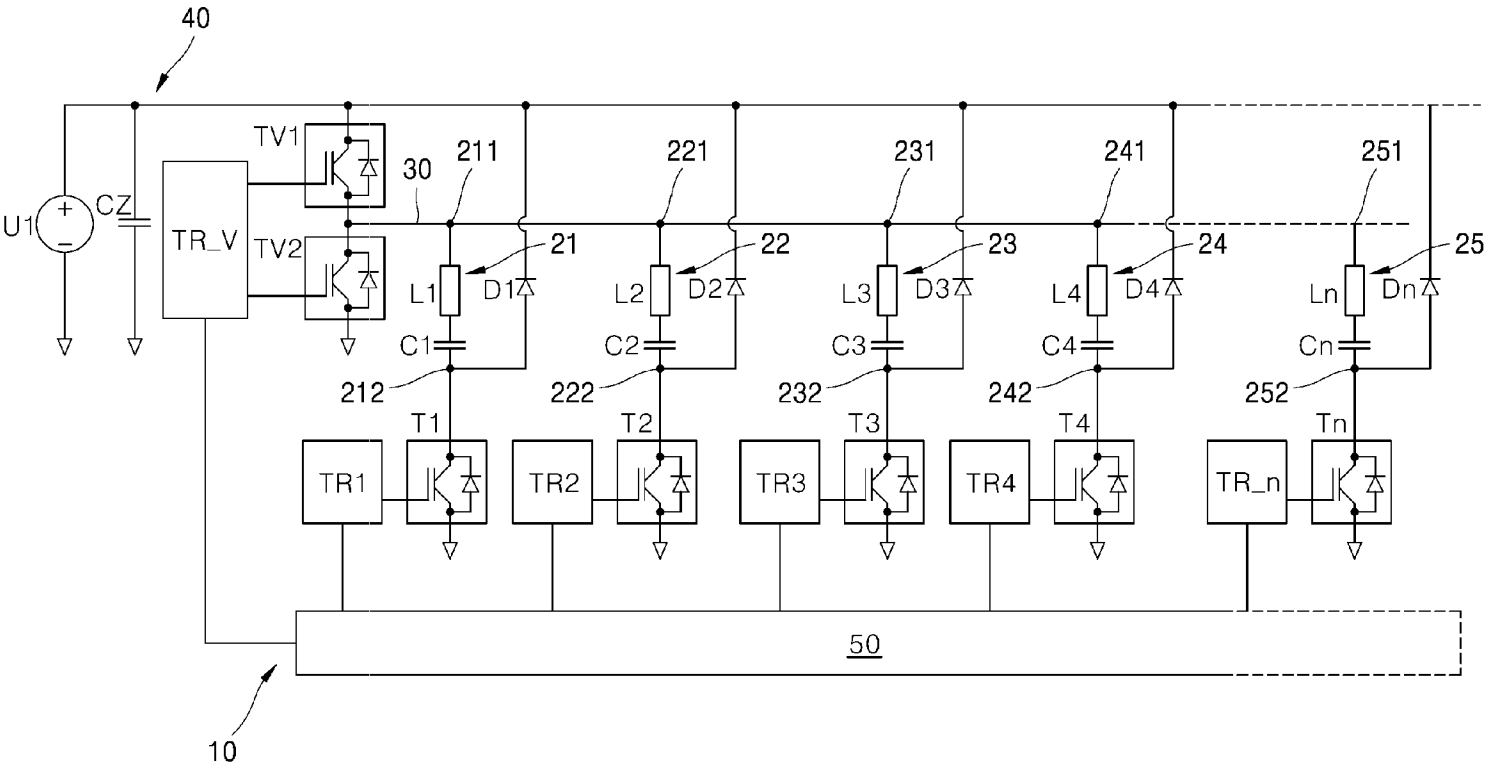
FIG. 1 Related Art
FIG. 1 is a schematic view illustrating a ZONE FREE type induction heating device in related art.

In the drawings, the same reference numeral is used to indicate the same or similar component.

Hereinafter, an induction heating device according to one or more implementations of this application will be described.

Figure 2:
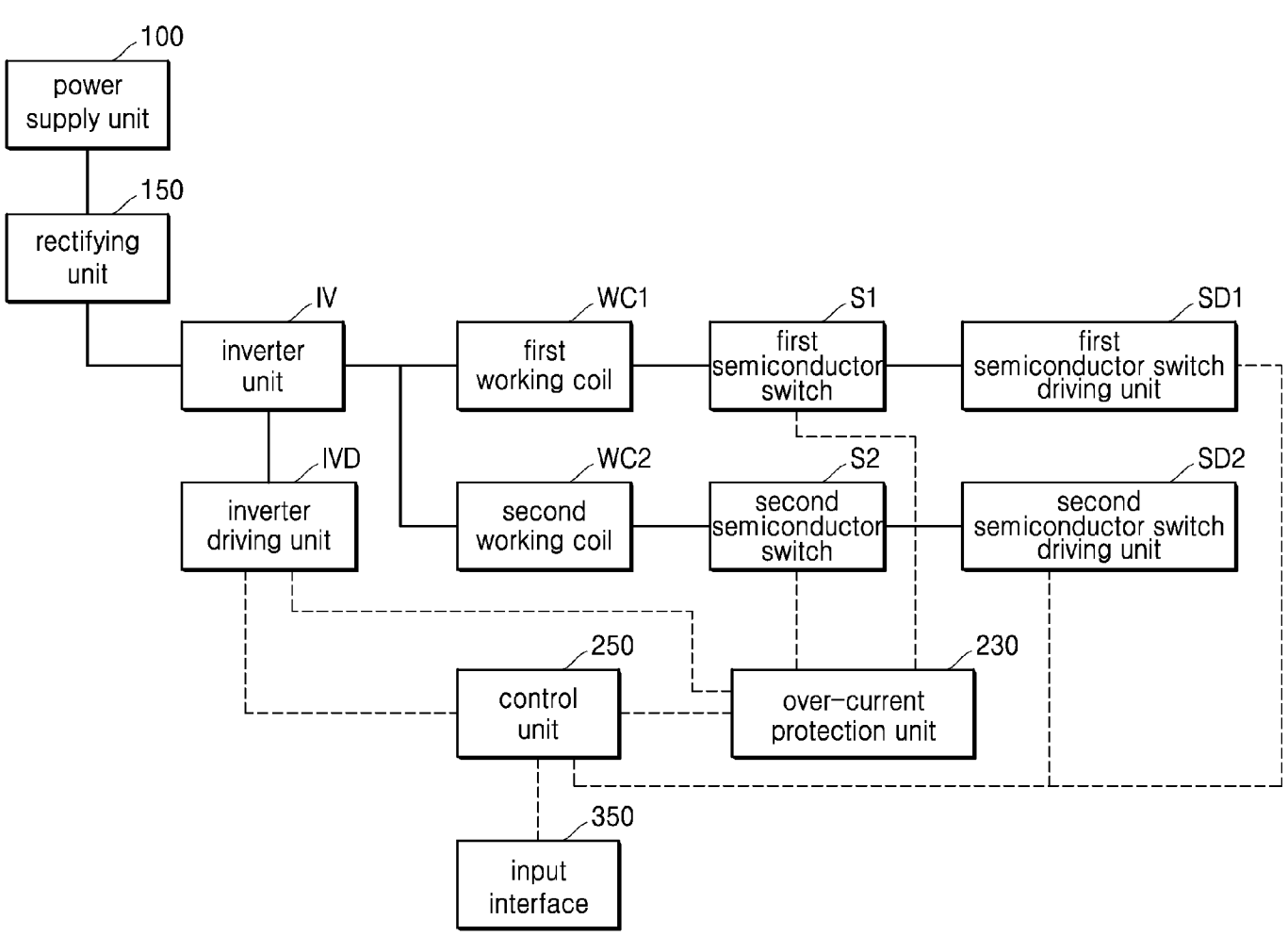
FIG. 2 is a block view illustrating an example induction heating device.

FIG. 2 is a block view illustrating an example of an induction heating device.

Referring to FIG. 2, an induction heating device 1 may include a power supply unit 100, a rectifying unit 150, an inverter unit an inverter driving unit IVD0, the first and second working coils WC1 and WC2, the first and second semiconductor switches S1 and S2, the first and second semiconductor switch driving units SD1 and SD2, an over-current protection unit 230, a control unit 250, an input interface 350.

In some implementations, the number of a part of the component of the induction heating device 1 shown in FIG. 2 (for example, an inverter unit, an inverter driving unit, a working coil, a semiconductor switch, a semiconductor switch driving unit, etc.) can be changed; however, in the implementations of this application, for convenience of explanation, the components shown in FIG. 2 will be described as an example.

The power supply unit 100 can output an alternating current power.

Specifically, the power supply unit 100 may output the alternating current power to provide it to the rectifying unit 150, and may be, for example, a commercial power supply.

The rectifying unit 150 may convert an alternating current power supplied from the power supply unit 100 into a direct current power to supply a converted direct current power to the inverter unit IV.

Specifically, the rectifying unit 150 may rectify the alternating current power supplied from the power supply unit 100 to convert a supplied alternating current power to the direct current power.

Figure 3:
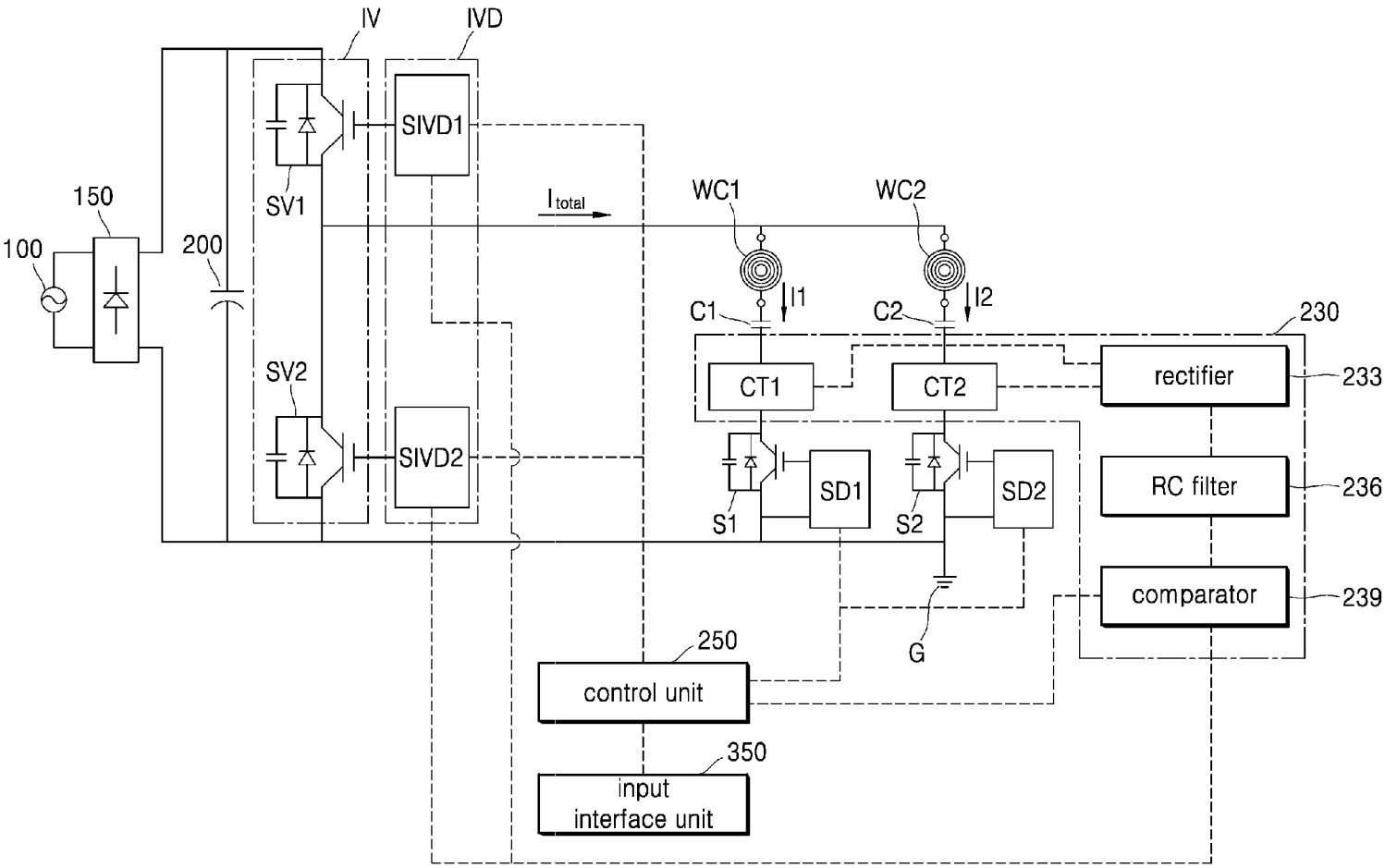
FIG. 3 is a schematic view for illustrating an example of an over-current protection unit of FIG. 2.

In some implementations, the direct current power rectified by the rectifying unit 150 may be provided to a direct current link capacitor 200 in FIG. 3 or a smoothing capacitor, and a direct current link capacitor 200 in FIG. 3 can reduce a Ripple of a corresponding direct current.

As described above, a direct current power rectified by the rectifying unit 150 and the direct current link capacitor 200 in FIG. 3 can be supplied to the inverter unit IV.

The inverter unit IV may perform a switching operation to apply a resonance current to at least one of the first a d second working coils WC1 and WC2.

More specifically, the inverter unit IV may receive the direct current power from the rectifying unit 150 to perform the switching operation. That is, the inverter unit IV nay receive a direct current power that is rectified by the rectifying unit 150 and the ripple is reduced by the direct current link capacitor 200 in FIG. 3. In some implementations, in the inverter unit IV, the switching operation can be controlled by the inverter driving unit IVD and it is possible to apply the resonant current to at least one of the first and second working coils WC1 and WC2 through the switching operation. That is, the inverter unit IV can drive a corresponding working coil by providing the resonance current to at least one of the first and second working coils WC1 and WC2, and accordingly, the corresponding working coil performs an induction heating operation.

In some implementations, the inverter unit IV may include a plurality of switching elements (for example, the first and second switching elements (SV1 and SV2 in FIG. 3) to perform the switching operation, and each of the plurality of switching elements may include, for example, insulated gate bipolar mode transistor (IGBT), but is not limited thereto.

In some implementations, the plurality of switching elements can be turned-on and turned-off alternately by the switching signal received from the inverter driving unit IVD. In some implementations, the alternating current of a high frequency (that is, the resonance current) can be generated by the switching operation of the plurality of switching elements, and a generated alternating current of a high frequency can be applied to any one of the first and second working coils WC1 and WC2.

The inverter driving unit IVD may be connected to the inverter unit IV, control the switching operation of the inverter unit IV.

Specifically, the inverter driving unit IVD may be controlled by the control unit 250 and may turn on or turn off the switching element provided in the inverter unit IV (i.e., the first and second switching elements SV1 and SV2 in FIG. 3).

That is, the inverter driving unit IVD can receive a pulse signal from the control unit 250, and can generate a switching signal based on a received pulse signal. In some implementations, the inverter driving unit IVD can control the switching operation of the switching element provided in the inverter unit IV by providing a generated switching signal to the inverter unit IV.

In some implementations, when an over-current flows in at least one of the first and second semiconductor switches S1 and S2, the inverter driving unit IVD may be turned-off (that is, the driving may be stopped) by the over-current protection unit 230. A specific matter thereof will be described later.

The first and second working coils WC1 and WC2 may be connected in parallel with each other.

Specifically, the first and second working coils WC1 and WC2 may be connected in parallel with each other to form a working coil unit, and may be applied with the resonance current from the inverter unit IV.

That is, when a driving mode of the induction heating device 1 is an induction heating mode, by the alternating current of the high frequency applied from the inverter unit IV to at least one of the first and second working coils WC1 and WC2, an eddy current may be generated between the corresponding working coil and a target object, so that the object can be heated.

In some implementations, when the driving mode of the induction heating device 1 is a wireless power transmission mode, a magnetic field may be generated in the corresponding working coil by the alternating current of the high frequency applied from the inverter unit IV to at least one of the first and second working coils WC1 and WC2. As a result, a current flows also in a coil inside a target object corresponded to the corresponding working coil, and the target object can be charged by the current that flows in the coil inside the target object.

In some implementations, the first working coil WC1 may be connected to the first semiconductor switch S1 and the second working coil WC2 may be connected to the second semiconductor switch S2.

Accordingly, each working coil can be turned-on or turned-off at the high speed by a corresponding semiconductor switch.

In some implementations, when the working coil is turned-on or turned-off by the semiconductor switch, a flow of the resonance current applied from the inverter unit to the working coil is unblocked or blocked by the semiconductor switch, respectively.

In some implementations, the first and second semiconductor switches S1 and S2 may be connected to the first and second working coils WC1 and WC2 respectively in order to turn on or turn off the first and second working coils WC1 and WC2, respectively.

Specifically, the first semiconductor switch S1 may be connected to the first working coil WC1 to turn on or turn off the first working coil WC1, and the second semiconductor switch S2 may be connected to the second working coil WC2 to turn on or turn off the second working coil WC2.

In some implementations, the first semiconductor switch S1 may be connected to the first semiconductor switch driving unit SD1 and can be controlled (i.e., turned-on or turned-off) by the first semiconductor switch driving unit SD1. The second semiconductor switch S2 may be connected to the second semiconductor switch driving unit SD2 and may be controlled (i.e., turned-on or turned-off) by the second semiconductor switch driving unit SD2.

In some implementations, the first and second semiconductor switches S1 and S2 may include, for example, a static switch. In some implementations, for example, a Metal oxide semiconductor field effect transistor (MOSFET) or an insulated gate bipolar mode transistor (IGBT) may be applied to the first and second semiconductor switches S1 and S2.

The first and second semiconductor switches S1 and S2 may be driven by the control unit 250 by keeping step with the inverter unit IV to be used in the case of determining whether the target object exists on the first and second working coils WC1 and WC2 or not or controlling an output of the first and second working coils WC1 and WC2.

In some implementations, the first and second semiconductor switches S1 and S2 can be supplied with a power from auxiliary power supply.

Specifically, the auxiliary power supply nay have a single output structure (i.e., an output terminal). Thus, the auxiliary power supply can supply a power to the first and second semiconductor switches S1 and S2 with a single output. In some implementations the auxiliary power supply can reduce the number of pins required for connection with the first and second semiconductor switches S1 and S2, as compared with other multiple output structures.

In some implementations, when a single output capacity is too large (that is, when a preset reference capacity is greatly deviated), the auxiliary power supply may be designed in a dual output structure (a structure in which each output terminal outputs it by dividing the single output capacity into a capacity of a preset reference capacity or less).

In some implementations, the auxiliary power supply may include, for example, a Switched mode power supply (SMPS), but is not limited thereto.

The first semiconductor switch driving unit SD1 may be connected to the first semiconductor switch S1 to control a driving of the first semiconductor switch S1.

Specifically, the first semiconductors itch driving unit SD1 can turn on or turn off the first semiconductor switch S1 and can be controlled by the unit 250. In some implementations, the second semiconductor switch driving unit SD2 may turn on or turn off the second semiconductor switch S2, and may be controlled by the control unit 250.

In some implementations, when the semiconductor switch is turned-on, the working coil connected to the corresponding semiconductor switch can also be turned-on, and when the semiconductor switch is turned-off, the working coil connected to the corresponding semiconductor switch can also be turned-off.

In some implementations, when the over-current flows in at least one of the first and second semiconductor switches S1 and S2, the semi conductor switch driving unit connected to the corresponding semiconductor switch can be turned-off by the control unit 250, and the specific matter thereof will be described later.

The control unit 250 can control the operation of the inverter driving unit IVD and the first and second semiconductor itch driving units SD1 and SD2, respectively.

Specifically, the control unit 250 can control the inverter driving unit IVD that turns-on or turns-off the switching element (i.e., the first and second switching elements SV1 and SV2 in FIG. 3) provided in the inverter unit IV to indirectly control the switching operation of the inverter unit IV. In some implementations, the control unit 250 can indirectly control an operation of the first semiconductor switch S1 by controlling the first semiconductor switch driving unit SD1 and can indirectly control an operation of the second semiconductor switch S2 by controlling the second semiconductor switch driving unit SD2.

For example, the inverter driving unit IVD drives the inverter unit IV according to a control of the control unit 250 and the first semiconductor switch driving unit SD1 turns-on the first semiconductor switch S1 according to the control of the control unit 250, the resonance current can be applied to the working coil WC1. In some implementations, a target object disposed on an upper portion of the first working coil WC1 can be heated by the resonance current applied to the first working coil WC1.

The control unit 250 can generate various pulse signals through a Pulse Width Modulation (PWM) function, and can provide a generated pulse signal to the inverter driving unit IVD.

In some implementations, a control signal that the control unit 250 provides to the first and second semiconductor switch driving units SD1 and SD2 may also be a form of a pulse signal, and a specific matter thereof will be omitted.

In some implementations, the control unit 250 may receive a first analysis result from the over-current protection unit 230 to be described later and determine whether turning off or not turning off of the pulse signal provided to the inverter driving unit IVD and turning off or not turning off of the first semiconductor switch driving unit SD1 based on a received first analysis result.

In some implementations, the control unit 250 may receive a second analysis result from the over-current protection unit 230 and determine turning off or not turning off of the pulse signal provided to the inverter driving unit IVD and turning off or not turning off of the second semiconductor switch driving unit SD2 based on a received second analysis result.

In some implementations, turning-off the pulse signal may include maintaining the pulse signal at a low level (for example, '0'), or not providing the pulse signal itself.

In some implementations, when the current flows in both the first and second semiconductor switches S1 and S2, the over-current protection unit 230 may simultaneously or sequentially generate the first and second analysis results, and thus, the control unit 250 may simultaneously or sequentially receive the first and second analysis results from the over-current protection unit 230. A specific matter thereof will be described later.

When the over-current flows in the semiconductor switch (for example, the first semiconductor switch S1), after the over-current protection unit 230 turns-off the inverter driving unit IVD, the control unit 250 may turn off the pulse signal provided to the inverter driving unit IVD and the semiconductor switch driving unit (for example, the first semiconductor switch driving unit SD1), and thus, a specific matter thereof will be described later.

In some implementations, the induction heating device 1 may have a wireless power transmission function.

That is, in recent years, a technology that supplies a power wirelessly is developed and applied to many electronic devices. In an electronic device applied with wireless power transmission technology, a battery may be charged by just placing it on a charging pad without connecting a separate charging connector. The electronic device to which the wireless power transmission is applied does not require a wire cord or a charging device, such that there may be an advantage in improving portability and reducing size/weight.

Such a wireless power transmission technology may largely include an electromagnetic induction method that, uses a coil, a resonance method that uses a resonance, and an electric wave emission method that converts an electric energy into a microwave and transmit it, etc. Among them, the electromagnetic induction method is a technology that uses an electromagnetic induction between a primary coil (for example, a working coil WC) provided in an device that transmits a wireless power and a secondary coil provided in an device that receives a wireless power to transmit a power.

In some implementations, the principle of an induction heating method of the induction heating device 1 may be substantially the same as the wireless power transmission technology by the electromagnetic induction in that it heats an object to be heated by an electromagnetic induction.

Thus, even in the case of the induction heating device 1, not only an induction heating function but also the wireless power transmission function can be mounted.

Accordingly, the control unit 250 can control the driving mode of the induction heating device 1, i.e., the induction heating mode or the wireless power transmission mode.

That is, when the driving mode of the induction heating device 1 is set to the wireless power transmission mode by the control unit 250, at least one of the first and second working coils WC1 and WC2 is driven to wirelessly transmit the power to the target object.

On the other hand, when the driving mode of the induction heating device 1 is set to the induction heating mode by the control unit 250, at least one of the first and second working coils WC1 and WC2 may be driven to heat the target object.

In some implementations, the number of working coils driven by the control of the control unit 250 can be determined, and an amount of transmitted power or a heating intensity of the induction heating device 1 can be changed depending on the number of the driven working coils. The control unit 250 can control an output intensity of the working coils WC1 and WC2 by adjusting a pulse width of the control signal provided to the semiconductor switches S1 and S2.

In some implementations, the control unit 250 can determine which working coil to drive according to a position of the target object (i.e., the object to be heated), and can also determine a synchronization or not of the switching signal between the working coils, which are the driving objects.

The control unit 250 may detect the resonance current that flows in the first and second working coils WC1 and WC2 and determine which working coil of the first and second working coils WC1 and WC2 to be disposed on the target object.

In some implementations, the control unit 250 may determine whether the target object is a magnetic body or a non-magnetic body based on the detection value.

Specifically, when the target object mounted on the upper portion of the induction heating device 1 is a magnetic body, as a large magnitude of eddy current is induced from the working coil to the target object and resonated, the relatively small magnitude of resonant current flows in the working coil. However, when the target object to be seated on the upper portion of the induction heating device 1 does not exist or when it is the non-magnetic body, since the working coil is not resonated, the relatively large magnitude of resonance current flows in the working coil.

Thus, the control unit 250 can determine that a driving object is a magnetic body when a magnitude of the resonance current that flows in the working coil is smaller than that of a preset reference current. Conversely, when the magnitude of the resonance current that flows in the working coil is equal to or greater than that of a preset reference current, the control unit 250 can determine that the target object does not exist or is the non-magnetic body.

In some implementations, the induction heating device 1 may further include a detection unit that detects the resonance current that flows in the working coils WC1 and WC2, and the detection unit may also perform the above-mentioned target object detection function.

However, for convenience of explanation, it will be described that the control unit 250 may perform the target object detection function as an example.

The input interface 350 may receive an input from a user and provide a corresponding input to a control unit 250.

Specifically, the input interface 350 may be a module that inputs a heating intensity that the user desires or a driving time of the induction heating device, etc., and may be variously realized by a physical button or a touch panel, etc.

In some implementations, a power supply button, a lock button, a power level adjustment button (+, −), a timer adjustment button (+, −), a charge mode button, etc., can be provided in the input interface 350.

The input interface 350 may provide received input information to the control unit 250 and the control unit 250 may variously drive the induction heating device 1 based on the input information received from the input interface 350, and an example thereof is as follows.

When the user touches the power supply button provided on the input interface 350 for certain time in a state in which the induction heating device 1 is not driven, the driving of the induction heating device 1 can be started. Conversely, when the user touches the power supply button for certain time in a state in which the induction heating device 1 is being driven, the driving of the induction heating device 1 may be ended.

In some implementations, when the user touches the lock button for certain time, it may be in a state in which an operation of all other buttons is not possible. Thereafter, when the user touches the lock button again for certain time, it may be in a state in which the operation of all other buttons is possible.

In some implementations, when the user touches the power level adjustment button (+, −) in a state in which a power supply is inputted, a current power level of the induction heating device 1 may be displayed numerically on the input interface 350. In some implementations, by a touch of the power level adjustment button (+, −), the control unit 250 can confirm that the driving mode of the induction heating device 1 is the induction heating mode. The control unit 250 may control a frequency for the switching operation of the inverter unit IV in order to correspond to an inputted power level by controlling the inverter driving unit IVD.

In some implementations, the user can set a driving time of the induction heating device 1 by touching the tinier adjustment button (+, −). The control unit 250 may terminate the driving of the induction heating device 1 when driving time that the user sets has elapsed.

At this time, when the induction heating device 1 operates in the induction heating mode, the driving time of the induction heating device 1 set by the timer adjustment button (+, −) can be heating time of a target object. In some implementations, when the induction heating device 1 operates in the wireless power transmission mode, the driving time of the induction heating device 1 set by the timer adjustment button (+, −) may be charging time of the target object.

On the other hand, when the user touches the charging mode button, the induction heating device 1 can be driven in the wireless power transmission mode.

At this time, the control unit 250 can receive device information on the corresponding target object through a communication with the target object seated on a driving area (i.e., an upper portion of a working coil). The device information transmitted from the target object may include information such as, for example, a type of a target object, a charging mode, and an amount of power required.

In some implementations, the control unit 250 can determine the type of the target object, and can grasp the charging mode of the target object based on the received device information.

In some implementations, the charging mode of the target object may include a normal charging mode and a high speed charging mode.

Accordingly, the control unit 250 can control the frequency of the inverter unit IV by controlling the inverter driving unit IVD according to a confirmed charging mode. For example, in the case of the high speed charging mode, the control unit 250 can adjust the frequency so that a larger magnitude of resonance current is applied to the working coil in accordance with the switching operation of the inverter unit IV.

In some implementations, the charging mode of the target object may be inputted by the user through the input interface 350.

The over-current protection unit 230 may be connected to the first and second semiconductor switches S1 and S2.

Specifically, the over-current protection unit 230 may be connected to the first semiconductor switch S1 and generate a first analysis result by analyzing the current that flows in the first semiconductor switch S1, and determine turning off or not turning off of the inverter driving unit IVD based on the first analysis result.

In some implementations, the over-current protection unit 230 may be connected to the second semiconductor switch S2 and generate the second analysis result by analyzing the current that flows in the second semiconductor switch S2, and determine turning off or not turning off of the inverter driving unit IVD based on the second analysis result.

In some implementations, when the current flows in both the first and second semiconductor switches S1 and S2, the over-current protection unit 230 may simultaneously or sequentially generate the first and second analysis results, and it is possible to simultaneously or sequentially provide produced first and second analysis results to the control unit 250, and the specific matter thereof will be described later.

As described above, the induction heating device 1 can have the above-mentioned feature and configuration.

Hereinafter, the feature and configuration of an example of the over-current protection unit 230 will be described in more specifically with reference to FIGS. 3 and 4.

FIG. 3 is a schematic view for illustrating an example of the over-current protection unit of FIG. 2. FIG. 4 is a flowchart illustrating an example a switch stress reduction method of the over-current protection unit and the control unit of FIG. 3.

First, referring to FIG. 3, an over-current protection unit 230 may include a first current transformer CT1, a second current transformer CT2, a rectifier 233, an RC filter 236, and a comparator 239.

Specifically, the first current transformer CT1 can convert the magnitude of a current I1 (Itotal−I2=I1) that flows between a first working coil WC1 and a first semiconductor switch S1. In some implementations, the first current transformer CT1 may include a primary coil connected between the first working coil WC1 and the first semiconductor switch S1 and a secondary coil connected to the rectifier 233.

In some implementations, the primary coil has the larger number of windings than the secondary coil, and thus, a magnitude of a current applied to the primary coil (i.e., the magnitude of the current I1 that flows bet the first working coil WC1 and the first semiconductor switch S1) may be greater than a magnitude of a current applied to the secondary coil (i.e., the current provided to the rectifier 233).

The second current transformer CT2 can change the magnitude of a current I2 that flows between a second working coil WC2 and a second semiconductor switch S2. In some implementations, the second current transformer CT2 may include a primary coil connected between the second working coil WC2 and the second semiconductor switch S2 and a secondary coil connected to the rectifier 233.

In some implementations, the primary coil has the larger number of windings than the secondary coil, and thus, the magnitude of the current applied to the primary coil (i.e., the current I2 that flows between the second working coil WC2 and the second semiconductor switch S2) may be greater than the magnitude of the current applied to the secondary coil (i.e., the current provided to the rectifier 233).

The rectifier 233 may receive a magnitude-converted current from at least one of the first and second current transformers CT1 and CT2 and can rectify a received current. In some implementations, the rectifier 233 may provide a rectified current to the RC filter 236.

The RC filter 236 may receive a rectified current from a rectifier 233 and can remove or reduce the noise of a received current in some implementations, the RC filter 236 may provide a noise-reduced current to a comparator 239. In some cases, the "noise-reduced" current may mean a noise-removed current in which some or all of the noise in a certain frequency range is removed from the rectified current from the rectifier 233 by the RC filter 236.

In some implementations, the RC filter 236 may include, for example, a Low-pass Filter to remove high frequency noise.

The comparator 239 may receive the noise-reduced current from the RC filter 236 and compare the magnitude of the received current with a preset over-current magnitude to generate an analysis result and determine turning off or not turning off of the inverter driving unit IVD based on the analysis result, and provide the analysis result to a control unit 250.

More specifically, when the current received from the RC filter 236 is a current delivered via the first current transformer CT1 and the rectifier 233, the comparator 239 may generate a first analysis result, and provide the produced first analysis result to the control unit 250. In some implementations, when the current received from the RC filter 236 is a current delivered via the second current transformer CT2 and the rectifier 233, the comparator 239 may generate a second analysis result and may provide the generated second analysis result to the control unit 250.

In some implementations, when the current flows in both the first and second semiconductor switches S1 and S2, the over current protection unit 230 can simultaneously or sequentially generate the first and second analysis results, and can simultaneously or sequentially provide the generated first and second analysis results to the control unit 250.

As described above, an example of the over-current protection unit 230 is configured, and a method of reducing a switch stress of the control unit 250 and an example of the over-current protection unit 230 will be described.

In some implementations, a stress reduction method for the first semiconductor switch S1 and a stress reduction method for the second semiconductor switch S2 are the same. Hereinafter, the first semiconductor switch S1 will be described as an example.

Figure 4:
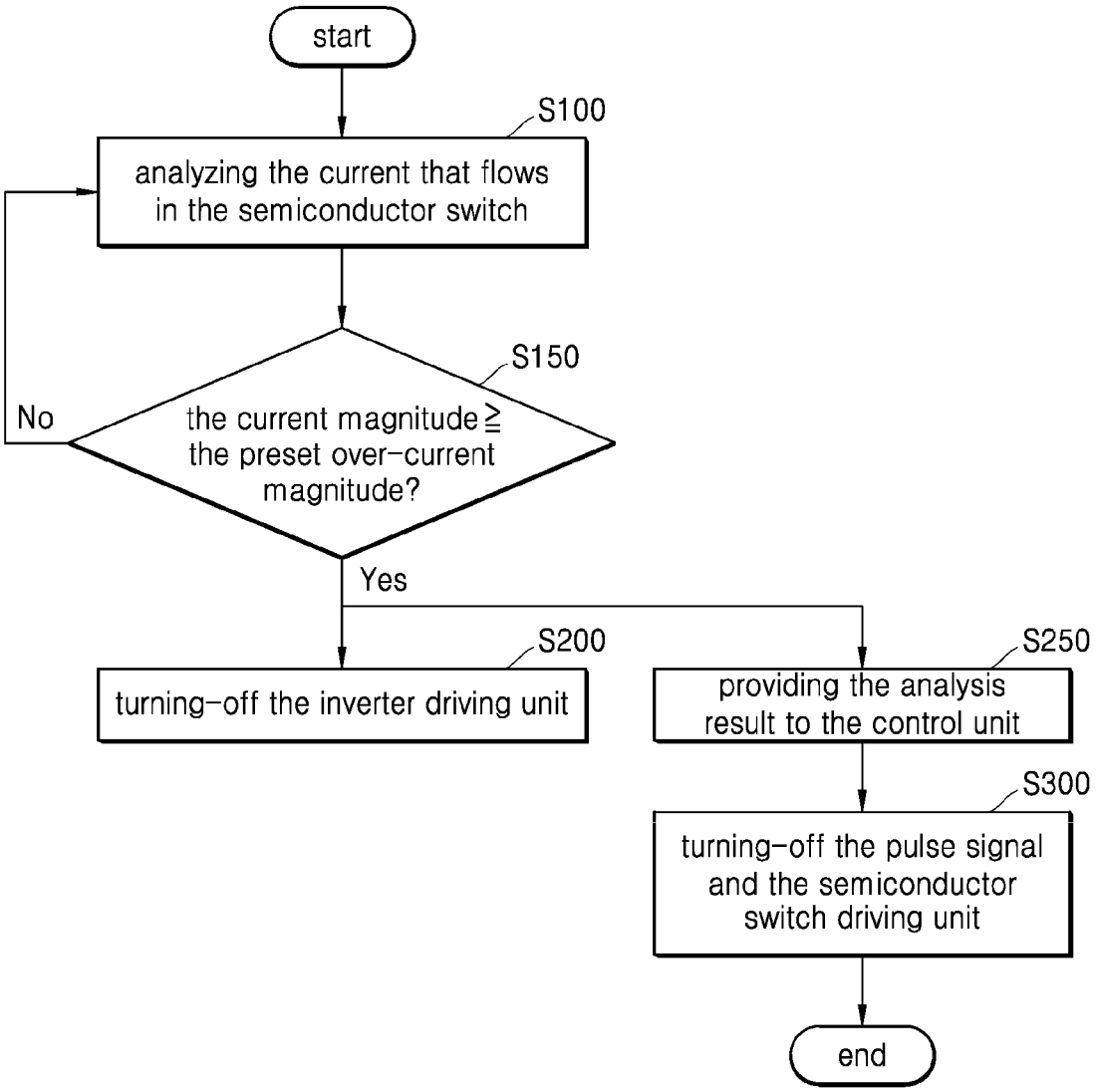
FIG. 4 is a flowchart illustrating an example of a switch stress reduction method of an over-current protection unit and a control unit of FIG. 3.

Referring to FIGS. 3 and 4, firstly, the over-current protection unit 230 may analyze the current that flows in the semiconductor switch (S100).

Specifically, in the over-current protection unit 230, it is possible to convert the magnitude of the current I1 that flows from the first working coil WC1 to the first semiconductor switch S1 through the first current transformer CT1, and rectify the magnitude-converted current through the rectifier 223, and then, remove the noise of the current rectified through the RC filter 236. In some implementations, in the over-current protection unit 230, it is possible to compare the noise-reduced current with the preset over-current magnitude through the comparator 239 to generate the first analysis result.

When the first analysis result indicates that the magnitude of the noise-reduced current received from the RC filter 236 is equal to or greater than the preset over-current magnitude (S150), it may turn off an inverter driving unit IVD (S200) and provide the first analysis result to the control unit 250 (S250).

Specifically, when the magnitude of the noise-reduced current received from the RC filter 236 is equal to or larger than the preset over-current magnitude, the comparator 239 may turn off the inverter driving unit IVD and may provide the first analysis result to the control unit 250.

Here, the inverter driving unit IVD may include a first s b-inverter driving unit SIVD1 connected to the first switching element SV1 to turn on or turn off a first switching element SV1, and a second sub-inverter driving unit SIVD2 connected to a second switching element SV2 to turn on or turn off a second sub-switching element. Thus, the comparator 239 can turn off both the first and second sub-inverter driving units SIVD1 and SIVD2.

In some implementations, when the inverter driving unit IVD is turned-off, an inverter unit IV driven by the inverter driving unit IVD can also be turned-off.

In some implementations, a turn-off of the inverter driving IVD (S200) and a provision of the first analysis result (S250) can proceed simultaneously or with slight time lag.

On the other hand, when the first analysis result indicates that the magnitude of the noise-reduced current received from the RC filter 236 is less than the magnitude of the preset over-current (S150), the over-current protection unit 230 may analyze the current that flows in the first semiconductor switch S1 again (S100).

Specifically, when the magnitude of the noise-reduced current received from the RC filter 236 is less than a preset over-current magnitude, the switch stress does not significantly occur even when the first semiconductor switch S1 is turned-off, so that a voltage spike may also not occur.

However, to prepare for emergency, the over-current protection unit 230 may continuously observe an occurrence or not of an over-current of the first semiconductor switch S1 by analyzing the current that flows in the first semiconductor switch S1 again.

In some implementations, when the current flows simultaneously in the first and second semiconductor switches S1 and S2, the over-current protection unit 230 may simultaneously analyze the current that flows in both the first and second semiconductor switches S1 and S2, and may sequentially analyze each current. Accordingly, the first analysis result indicates that the magnitude of the noise-reduced current received from the RC filter 236 is less than the magnitude of the preset over-current in the state in which the current simultaneously flows in the first and second semiconductor switches S1 and S2, the over-current protection unit 230 may analyze the current I2 that flows in the second semiconductor switch S2, not the first semiconductor switch S1. Alternatively, it is also possible to simultaneously analyze the current that flows in the first and second semiconductor switches S1 and S2.

However, for convenience of explanation, it will be described that the over-current protection unit 230 analyzes the current that flows in the first semiconductor switch S1 again as an example.

On the other hand, when the comparator 239 turns-off the inverter driving unit IVD (S200) and provides the first analysis result to the control unit 250 (S250), it may turn off the pulse signal and the first semiconductor switch driving unit (S300).

Specifically, the control unit 250 may receive the first analysis result from the comparator 239, and turn off the pulse signal provided to the inverter driving unit IVD and the first semiconductor switch driving unit SD1 based on the received first analysis result.

Here, as mentioned above, the inverter driving unit IVD may include the first and second sub-inverter driving units SIVD1 and SIVD2, and the control unit 250 may turn off the pulse signal provided to the first and second sub-inverter driving units SIVD1 and SIVD2, respectively.

In some implementations, when a first semiconductor switch driving unit SD1 is turned-off, the first semiconductor switch S1 driven by the first semiconductor switch driving unit SD1 may also be turned-off.

As described above, when the over current flows in the first semiconductor switch S1, the comparator 239 may firstly turn off the inverter driving unit IVD to stop a driving of the inverter unit IV, and thus, the supply of the over-current, which was provided to the first semiconductor switch S1, may be stopped. Accordingly, even when the control unit 250 turns-off the pulse signal provided to the inverter driving unit IVD and the first semiconductor switch driving unit SD1, the switch stress applied to the first semiconductor switch S1 may be reduced, so that a voltage spike or a damage according to an increase in a heating value can be prevented.

As mentioned above, an example of the over-current protection unit and the control unit of FIG. 3 may reduce the switch stress. Hereinafter, with reference to FIG. 5 and FIG. 6, a characteristic and a configuration of another example of an over-current protection unit 230 will be described in more specifically.

Figure 5:
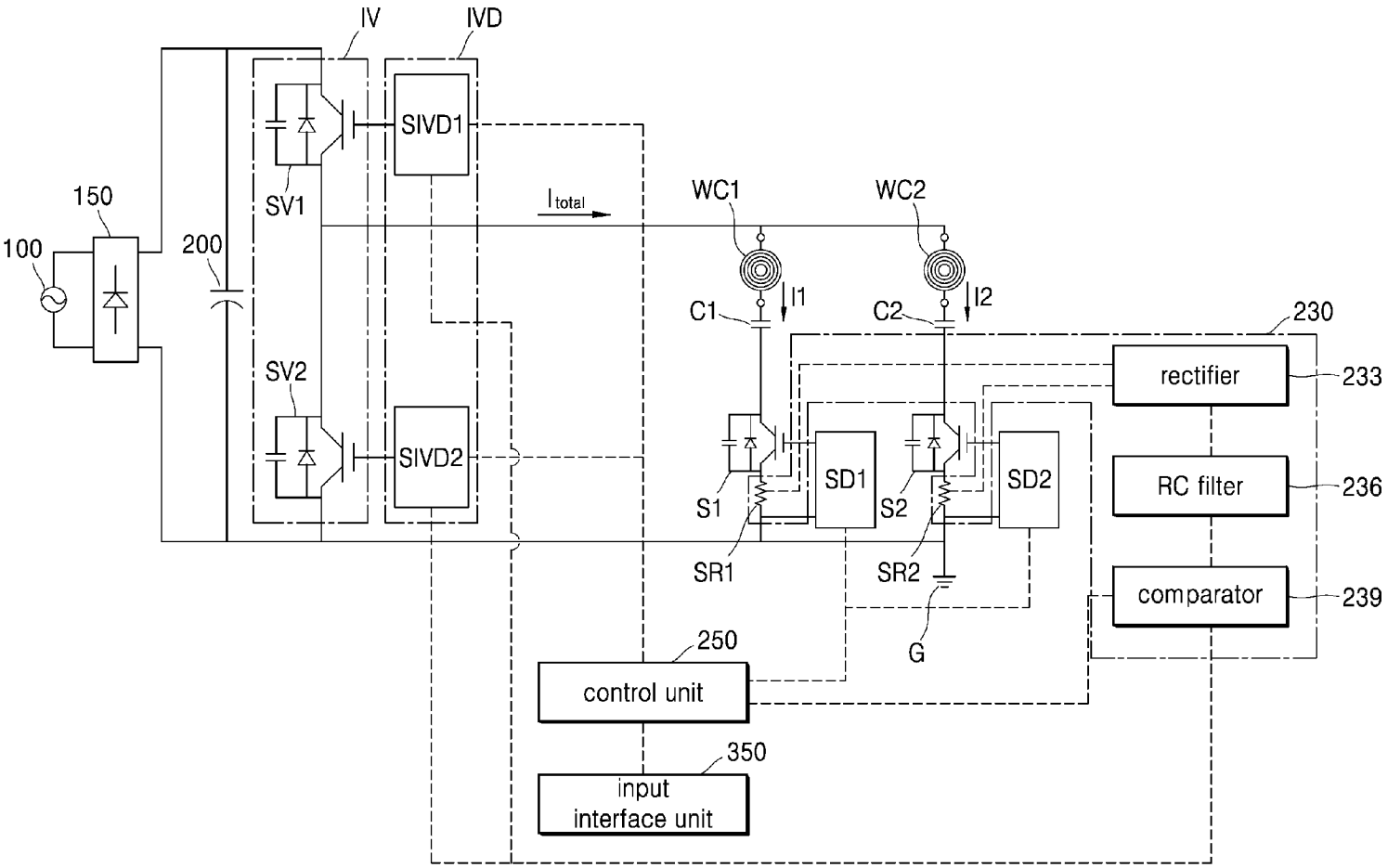
FIG. 5 is a schematic view illustrating another example of an over-current protection unit of FIG. 2.
Figure 6:
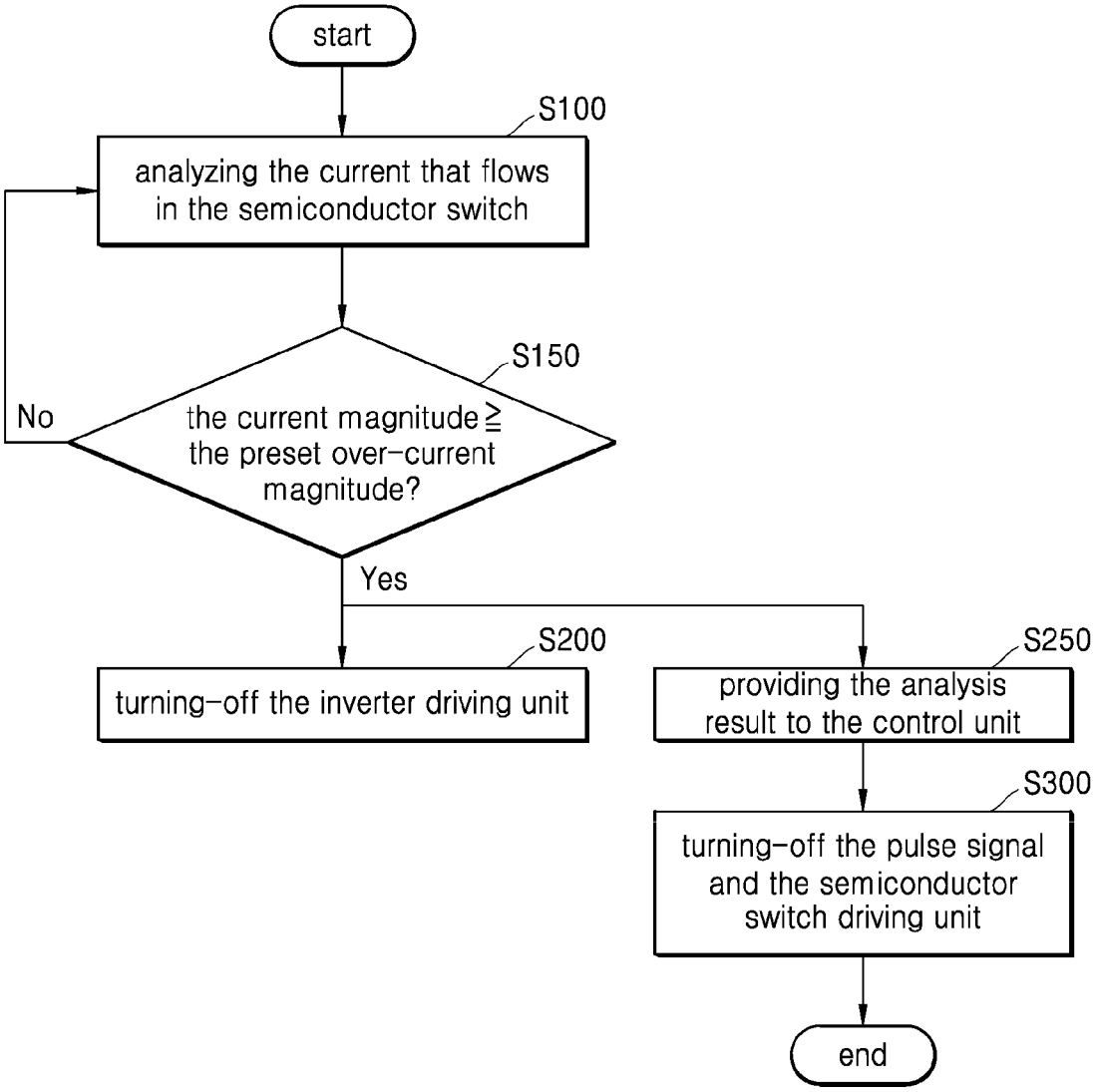
FIG. 6 is a flowchart illustrating an example of a switch stress reduction method of an over-current protection unit and a control unit of FIG. 5.

FIG. 5 is a schematic view illustrating another example of the over-current protection unit of FIG. 2. FIG. 6 is a flowchart illustrating an example of a switch stress reduction method of the over-current protection unit and a control unit of FIG. 5.

Firstly, referring to FIG. 5, an over-current protection unit 230 may include a first shunt resistor SR1, a second shunt resistor SR2, a rectifier 233, an RC filter 236, and a comparator 239.

Specifically, the first shunt resistor SR1 may be connected between a first semiconductor switch S1 and a ground G.

In some implementations, a magnitude of a voltage applied to both ends of the first shunt resistor SR1 has to be included in a voltage range measurable in the comparator 239, so that a resistance value of the first shunt resistor SR1 may be very small.

Accordingly, even when the over-current flows in the first semiconductor switch S1, the magnitude of the voltage applied to the first shunt resistor SR1 can be included within a voltage range measurable in the comparator 239.

The second shunt resistor SR2 may be connected between a second semiconductor switch S2 and a ground G.

Since a magnitude of a voltage applied to both ends of the second shunt resistor SR2 has to be included within a voltage range measurable in the comparator 239, a resistance value of the second shunt resistor SR2 may also be very small.

Accordingly, even when the over-current flows in the second semiconductor switch S2, the magnitude of the voltage applied to the second shunt resistor SR2 can be included within the voltage range measurable in the comparator 239.

The rectifier 233 can rectify a voltage applied to at least one of the first and second spur resistors SR1 and SR2. In some implementations, the rectifier 233 may provide the rectified voltage to the RC filter 236.

The RC filter 236 may receive the rectified voltage from the rectifier 233 and can remove or reduce noise of a received voltage. In some implementations, the RC filter 236 may provide a noise-reduced voltage to a comparator 239. In some cases, the "noise-reduced" voltage may mean a noise-removed voltage in which some or all of the noise in a certain frequency range is removed from the rectified voltage from the rectifier 233 by the RC filter 236.

In some implementations, the RC filter 236 may include, for example a Low-pass Filter to remove high frequency noise.

The comparator 239 may receive the noise-reduced voltage from the RC filter 236, and compare a magnitude of a received voltage with a preset over-voltage magnitude to generate an analysis result, and determined turning off or not turning off of an inverter driving unit IVD based on the analysis result, and provide the analysis result to a control unit 250.

More specifically, when the voltage received from the RC filter 236 is a voltage delivered via the first shunt resistor SR1 and the rectifier 233, the comparator 239 may generate the first analysis result, and provide the generated analysis result to the control unit 250. In some implementations, when the voltage received from the RC filter 236 is the voltage delivered via the second shunt resistor SR2 and the rectifier 233, the comparator 239 may generate the second analysis result, and provide the generated second analysis result to the control unit 250.

In some implementations, when the current flows in both the first and second semiconductor switches S1 and S2, the over current protection unit 230 can simultaneously or sequentially generate the first and second analysis results, and simultaneously or sequentially provide the generated first and second analysis results to the control unit 250.

In some implementations, in another example of the over-current protection unit 230, the rectifier 233 and the RC filter 236 may be omitted. However, for convenience of explanation, it will be described that another example of the over-current protection unit 230 may include the rectifier 233 and the RC filter 236 as an example.

In some implementations, another example of the over-current protection unit 230 is different from an example of the over-current protection unit 230 in that it converts the current that flows in the first and second semiconductor switches S1 and S2 to a voltage through the first and second shut resistors SR1 and SR2

As described above, another example of the over-current protection unit 230 may be configured. A switch stress reduction method of the control unit 250 and another example of the over-current protection unit 230 will be as follows.

In some implementations, a stress reduction method for a first semiconductor switch S1 and a stress reduction method for a second semiconductor switch S2 are the same. Hereinafter, the first semiconductor switch S1 will be described as an example.

Referring to FIGS. 5 and 6, firstly, a current that flows in a semiconductor switch may be analyzed (S100).

Specifically, the over-current protection unit 230 may rectify the voltage applied to the first shunt resistor SRI through the rectifier 233, and then remove the noise of the rectified voltage through the RC filter 236. In some implementations, the over-current protection unit 230 may compare the noise-reduced voltage with the preset over-voltage magnitude through the comparator 239 to generate the first analysis result.

If the first analysis result indica s that the magnitude of the noise-reduced voltage received from the RC filter 236 is equal to or larger than a preset over-voltage magnitude (S160), it may turn off an inverter driving unit IVD and may provide the first analysis result to the control unit 250 (S250).

Specifically, when the magnitude of the noise-reduced voltage received from the RC filter 236 is equal to or greater than the preset over-voltage magnitude, the comparator 239 may turn off the inverter driving unit IVD and provide the first analysis result to the control unit 250.

Here, the inverter driving unit IVD may include a first sub-inverter driving unit SIVD1 connected to the first switching element SV1 to turn on or turn off the first switching element SV1, and a second sub-inverter driving unit SIVD1 connected to the second switching element SV2 to turn on or turn off a second switching element SV2. Thus, the comparator 239 may turn off both the first and second sub-inverter driving units SIVD1 and SIVD2.

In some implementations, when the inverter driving unit IVD is turned-off, an inverter unit IV driven by the inverter driving unit IVD can also be turned-off.

In some implementations, a turn-off of the inverter driving unit (IVD) (S200) and a provision of the first analysis result (S250) can be performed simultaneously or with slight time lag.

On the other hand, when the first analysis result indicates that the magnitude of the noise-reduced voltage received from the RC filter 236 is less than the preset over-voltage magnitude (S160), the over-current protection unit 230 may analyze a current I1 that flows in the first semiconductor switch S1 again (S100).

Specifically, when the magnitude of the noise-reduced voltage received from the RC filter 236 is less than the preset over-voltage magnitude, switch stress does not significantly occur even when the first semiconductor switch S1 is turned-off, and a voltage spike may not also occur.

However, to prepare for emergency, the over-current protection unit 230 can continuously observe an occurrence or not of an over-current of the first semiconductor switch S1 by analyzing the current I1 that flows in the first semiconductor switch S1 again.

In some implementations, when the current flows simultaneously in the first and second semiconductor switches S1 and S2, the over-current protection unit 230 may simultaneously analyze the current that flows in both the first and second semiconductor switches S1 and S2, and may sequentially analyze each current. Accordingly, when the first analysis result indicates that the magnitude of the noise-reduced voltage received from the RC filter 236 is less than the preset over-voltage magnitude in the state in which the current flows in the first and second semiconductor switches S1 and S2 simultaneously, the over-current protection unit 230 may also analyze the current I2 that flows in the second semiconductor switch S2, not the first semiconductor switch S1. Alternatively, the over-current protection unit 230 may also analyze the current that flows in the first and second semiconductor switches S1 and S2 simultaneously.

However, for convenience of explanation, it will be described that the over-current protection unit 230 analyzes the current that flows in the first semiconductor switch S1.

On the other hand, when the comparator 239 turns-off the inverter driving unit IVD (S200) and provides the first analysis result to the control unit 250 (S250), it may turn off the pulse signal and the first semiconductor switch driving units (300).

Specifically, the control unit 250 may receive the first analysis result from the comparator 239, and turn off the pulse signal provided to the inverter driving unit IVD and a first semiconductor switch driving unit SD1 based on the received first analysis result.

Here, the inverter driving unit BID may include the first and second sub-inverter driving units SIVD1 and SIVD2 as mentioned above, and the control unit 250 may turn off the pulse signal provided to each of the first and second sub-inverter driving units SIVD1 and SIVD2.

In some implementations, when the first semiconductor switch driving unit SD1 is turned-off, the first semiconductor switch S1 driven by the first semiconductor switch driving unit SD1 can also be turned-off.

As described above, when the over-current flows in the first semiconductor switch S1, the comparator 239 may firstly turn off the inverter driving unit to stop a driving of the inverter unit IV, and the supply of the over-current, which was provided to the first semiconductor switch S1, may be stopped. Accordingly, even when the control unit 250 turns-off the pulse signal provided to the inverter driving unit IVD and the first semiconductor switch driving unit SD1, the switch stress applied to the first semiconductor switch S1 is reduced, a voltage spike or a damage according to an increase in a heaving value can be prevented.

As mentioned above, in the induction heating device 1, the independent output control with regard to the plurality of working coils is possible by independently dividing the plurality of working coils to turn on or turn off each working coil at high speed through the semiconductor switch and the control unit.

In some implementations, the induction heating device 1 can reduce the switch stress without the Free Wheeling Diode by always firstly turning-off the inverter driving unit before turning-off the pulse signal and the semiconductor switch driving unit. In some implementations, through the switch stress reduction, the voltage spike occurrence prevention and the reduction in the heating value of the semiconductor switch is possible, and as a result, an improvement in a product lifespan and reliability is possible.

In some implementations, the induction heating device 1 can address a noise problem that can occur in a switching operation of the relays by performing an output control operation on the working coil by using the semiconductor switch instead of a relay, and as a result, it is possible to improve a user satisfaction. In some implementations, since the user can quietly use it even in a time zone (for example, at dawn or at late night) sensitive to the noise problem, a use convenience can be improved. In addition to that, it is possible to reduce a circuit volume by removing a relay and a Free Wheeling Diode that occupy volume a lot in a circuit, and as a result, it is also possible to reduce a total volume of the induction heating device. In some implementations, it is possible to improve space utilization by reducing the total volume of the induction heating device.

As described above, while this application has been described with reference to the exemplary drawings thereof, this application is not limed by the drawings and the implementations disclosed in this application, and it is apparent that various changes can be made by those skilled in the art in the range of the technical idea of this application. In some implementations, although it is not explained by explicitly describing the working effect according to the configuration of this application while describing the implementations of this application in the above, it is needless to say that a predictable effect has to be also recognized by the corresponding configuration.

What is claimed is:

1. An induction heating device, comprising:

a working coil unit comprising a first working coil and a second working coil that are connected electrically in parallel;

an inverter unit configured to perform a switching operation by applying a resonance current to at least one of the first working coil or the second working coil;

an inverter driving unit connected to the inverter unit and configured to control the switching operation of the inverter unit;

a first semiconductor switch connected to the first working coil and configured to turn on and turn off the first working coil;

a first semiconductor switch driving unit connected to the first semiconductor switch and configured to control the first semiconductor switch;

an over-current protection unit comprising a first current transformer disposed between the first working coil and the first semiconductor switch and configured to convert a magnitude of a current that flows between the first working coil and the first semiconductor switch, the over-current protection unit being configured to:

generate a first current by rectifying and noise-reducing a magnitude-converted current received from the first current transformer, compare a magnitude of the first current with a preset over-current magnitude to generate first information, based on the first information, determine whether to turn on or off the inverter driving unit; and a control unit that is configured to:

receive the first information from the over-current protection unit, and based on the first information, determine whether to block or unblock a pulse signal to the inverter driving unit and whether to turn on or off the first semiconductor switch driving unit.

2. The induction heating device of claim 1, wherein the over-current protection unit further comprises:

a rectifier configured to rectify the magnitude-converted current from the first current transformer;

an RC filter configured to reduce a noise from a rectified current received from the rectifier; and a comparator configured to:

compare the magnitude of the first current with the preset over-current magnitude, generate the first information based on a comparison result of the magnitude of the first current with the preset over-current magnitude, based on the first information, determine whether to turn on or off the inverter driving unit, and provide the first information to the control unit.

3. The induction heating device of claim 2, wherein the first current transformer comprises a primary coil connected between the first working coil and the first semiconductor switch and a secondary coil connected to the rectifier.

4. The induction heating device of claim 1, wherein:

the over-current protection unit is configured to, based on the first information indicating that the magnitude of the first current is greater than or equal to the preset over-current magnitude, turn off the inverter driving unit; and the control unit is configured to, based on the first information indicating that the magnitude of the first current is greater than or equal to the preset over-current magnitude, block the pulse signal to the inverter driving unit and turn off the first semiconductor switch driving unit.

5. The induction heating device of claim 4, wherein the control unit is further configured to, based on the over-current protection unit having turned off the inverter driving unit, block the pulse signal to the inverter driving unit and turn off the first semiconductor switch driving unit.

6. The induction heating device of claim 1, wherein the inverter unit comprises a first switching element and a second switching element that are configured to perform the switching operation, and wherein the inverter driving unit comprises:

a first sub-inverter driving unit connected to the first switching element and configured to turn on and turn off the first switching element; and a second sub-inverter driving unit connected to the second switching element and configured to turn on and turn off the second switching element.

7. The induction heating device of claim 6, wherein:

the over-current protection unit is configured to, based on the first information indicating that the magnitude of the first current is greater than or equal to the preset over-current magnitude, turn off the first sub-inverter driving unit and the second sub-inverter driving unit; and the control unit is configured to, based on the first information indicating that the magnitude of the first current is greater than or equal to the preset over-current magnitude, block a first pulse signal to the first sub-inverter driving unit and a second pulse signal to the second sub-inverter driving unit, and turn off the first semiconductor switch driving unit.

8. The induction heating device of claim 7, wherein the control unit is further configured to, based on the over-current protection unit having turned off the first sub-inverter driving unit and the second sub-inverter driving unit, block the first pulse signal and the second pulse signal and turn off the first semiconductor switch driving unit.

9. The induction heating device of claim 1, further comprising:

a second semiconductor switch connected to the second working coil and configured to turn on and turn off the second working coil; and a second semiconductor switch driving unit connected to the second semiconductor switch and configured to control the second semiconductor switch.

10. The induction heating device of claim 9, wherein the over-current protection unit further comprises a second current transformer disposed between the second working coil and the second semiconductor switch and configured to convert a magnitude of a current that flows between the second working coil and the second semiconductor switch, wherein the over-current protection unit is configured to:

generate a second current by rectifying and noise-reducing a magnitude-converted current received from the second current transformer, compare a magnitude of the second current with the preset over-current magnitude to generate second information, and determine whether to turn on or off the inverter driving unit based on the second information, and wherein the control unit is further configured to:

receive the second information from the over-current protection unit, and based on the second information, determine whether to block or unblock the pulse signal to the inverter driving unit and whether to turn on or off the second semiconductor switch driving unit.

11. The induction heating device of claim 10, wherein:

the over-current protection unit is configured to, based on the first current flowing in the first semiconductor switch and the second current flowing in the second semiconductor switch, simultaneously or sequentially generate the first information and the second information; and the control unit is configured to, based on the first current flowing in the first semiconductor switch and the second current flowing in the second semiconductor switch, simultaneously or sequentially receive the first information and the second information from the over-current protection unit.

12. An induction heating device, comprising:

a working coil unit comprising a first working coil and a second working coil that are connected electrically in parallel;

an inverter unit configured to perform a switching operation by applying a resonance current to at least one of the first working coil or the second working coil;

an inverter driving unit connected to the inverter unit and configured to control the switching operation of the inverter unit;

a first semiconductor switch connected to the first working coil and configured to turn on and turn off the first working coil;

a first semiconductor switch driving unit connected to the first semiconductor switch and configured to control the first semiconductor switch;

an over-current protection unit comprising a first shunt resistor connected between the first semiconductor switch and a ground, the over-current protection unit being configured to:

generate a first voltage by rectifying and noise-reducing a voltage applied to the first shunt resistor, compare a magnitude of the first voltage with a preset over-voltage magnitude to generate first information, and based on the first information, determine whether to turn on or off the inverter driving unit; and a control unit that is configured to:

receive the first information from the over-current protection unit, and based on the first information, determine whether to block or unblock a pulse signal to the inverter driving unit and whether to turn on or off the first semiconductor switch driving unit.

13. The induction heating device of claim 12, wherein the over-current protection unit further comprises:

a rectifier configured to rectify the voltage applied to the first shunt resistor;

an RC filter configured to reduce a rectified voltage received from the rectifier and output the first voltage; and a comparator configured to:

compare the magnitude of the first voltage with the preset over-voltage magnitude, generate the first information based on a comparison result of the magnitude of the first voltage with the preset over-voltage magnitude, based on the first information, determine whether to turn on or off the inverter driving unit, and provide the first information to the control unit.

14. The induction heating device of claim 12, wherein:

the over-current protection unit is configured to, based on the first information indicating that the magnitude of the first voltage is greater than or equal to the preset over-voltage magnitude, turn off the inverter driving unit; and the control unit is configured to, based on the first information indicating that the magnitude of the first voltage is greater than or equal to the preset over-voltage magnitude, block the pulse signal to the inverter driving unit and turn off the first semiconductor switch driving unit.

15. The induction heating device of claim 14, wherein the control unit is further configured to, based on the over-current protection unit having turned off the inverter driving unit, block the pulse signal to the inverter driving unit and turn off the first semiconductor switch driving unit.

* * * * *